US011665476B2

(12) United States Patent
Nahra et al.

(10) Patent No.: US 11,665,476 B2
(45) Date of Patent: May 30, 2023

(54) PORTABLE WIRELESS SPEAKER ARRANGEMENT COMPRISING REPLACEABLE CASING WITH INTEGRATED BATTERY

(71) Applicants: Loui Nahra, Karlstad (SE); Daniel Lauritsen, Karlstad (SE)

(72) Inventors: Loui Nahra, Karlstad (SE); Daniel Lauritsen, Karlstad (SE)

(73) Assignee: HYNELL INTELLECTUAL PROPERTY AB, Stockholm (SE)

( * ) Notice: Subject to any disclaimer, the term of this patent is extended or adjusted under 35 U.S.C. 154(b) by 0 days.

(21) Appl. No.: 17/288,738

(22) PCT Filed: Oct. 22, 2019

(86) PCT No.: PCT/SE2019/051040
§ 371 (c)(1),
(2) Date: Apr. 26, 2021

(87) PCT Pub. No.: WO2020/091653
PCT Pub. Date: May 7, 2020

(65) Prior Publication Data

US 2021/0400385 A1 Dec. 23, 2021

(30) Foreign Application Priority Data

Oct. 31, 2018 (SE) ..... 1851363-0

(51) Int. Cl.
*H04R 3/12* (2006.01)
*H04R 1/02* (2006.01)

(52) U.S. Cl.
CPC ..... *H04R 3/12* (2013.01); *H04R 1/02* (2013.01); *H04R 2420/07* (2013.01)

(58) Field of Classification Search
CPC ..... H04R 3/12; H04R 1/02; H04R 2420/07
(Continued)

(56) References Cited

U.S. PATENT DOCUMENTS 9,277,103 B1 3/2016 Hales et al.
9,344,793 B2 * 5/2016 Selig ..... H04R 1/1083
(Continued)

FOREIGN PATENT DOCUMENTS

EP 1685929 A1 8/2006
GB 2525767 B 1/2017
(Continued)

OTHER PUBLICATIONS

International search report for related application PCT/SE2019/051040 dated Dec. 12, 2019.

*Primary Examiner* — Disler Paul
(74) *Attorney, Agent, or Firm* — Schott P.C.

(57) ABSTRACT

A portable wireless speaker arrangement includes a speaker module, a rigid casing that at least partially encloses the speaker module, and a user interaction unit adapted to allow user input. The speaker module may include a speaker element for generation of audio and at least one electric circuit configured for receiving, from a source device, a signal representing the audio and configured for providing an electric output signal to be fed to the speaker element for the generation of the audio. The speaker module may be received by the casing to allow for insertion thereof into the rigid casing and removal thereof from the casing. The casing at least partially encloses the speaker module in that the casing includes an opening in which the speaker element of the speaker module is arranged. The casing may include a set of battery elements that is integrated with the casing.

8 Claims, 4 Drawing Sheets

(58) Field of Classification Search
USPC ..... 381/77, 79, 304–305, 345
See application file for complete search history.

(56) References Cited

U.S. PATENT DOCUMENTS

| | | | | |
|---|---|---|---|---|
| 9,641,921 | B2 * | 5/2017 | Garfio | H04R 1/02 |
| 10,091,584 | B2 * | 10/2018 | Barone | H04R 1/26 |
| 10,165,367 | B2 * | 12/2018 | Lopez | H04R 5/02 |
| 10,390,128 | B2 * | 8/2019 | Fathollahi | H04R 9/06 |
| 2014/0098979 | A1 | 4/2014 | Osborn et al. | |
| 2017/0189768 | A1 | 7/2017 | Dingle | |
| 2017/0195763 | A1 | 7/2017 | Cheney et al. | |
| 2017/0251305 | A1 | 8/2017 | Fathollahi | |
| 2018/0131119 | A1 | 5/2018 | Makwinski | |
| 2018/0368559 | A1 | 12/2018 | Wang et al. | |

FOREIGN PATENT DOCUMENTS

| | | | |
|---|---|---|---|
| JP | 2010081165 | A | 4/2010 |
| WO | 2015103312 | A1 | 7/2015 |

* cited by examiner

Planview of crossection C1

Planview of crossection C2

PORTABLE WIRELESS SPEAKER ARRANGEMENT COMPRISING REPLACEABLE CASING WITH INTEGRATED BATTERY

TECHNICAL FIELD

The present invention relates to wireless speakers, such as Bluetooth enabled speakers. In particular, a wireless portable speaker arrangement is disclosed herein.

BACKGROUND

Wireless speakers have existed on the marked for some time and are popular due to their easy to use and easy to install thanks to that no cables or wires are required to hook up the speaker to a user interaction unit, such as a smartphone or the like, which can fed audio, such as music, podcasts, audio of video or the like, to the wireless speakers.

A few known variants of wireless speakers will be presented in the following.

True Wireless Stereo (TWS) speakers enables two separate Bluetooth enabled speakers to provide an audio experience in stereo to a listener without any wiring between the two speakers. The speakers a paired with each other and a controller device, such as a mobile phone or the like, only is paired with, and connected to, one of the separate speakers. Pairing is a well-known concept within Bluetooth technology and enables devices to automatically connect to each other when in range once the devices have been paired. For example, a user pairs a set of earphones with the user's smartphone once and then the earphones will automatically connect to the phone when in range without requiring a new pairing process.

Some known BT-speakers allows the user to change the appearance of the speaker by changing a jacket that encloses the speaker device. The changeable jackets can have different colours and textures in order to fit with different user's styles. This kind of speaker is known from e.g. WO2015103312, which discloses a portable speaker that can be enclosed in interchangeable speaker enclosures, or jackets.

This known portable BT speaker addresses how to adapt the speaker's appearance to the user's style. A disadvantage is that the known BT speaker only allows the user to adapt the speaker 's appearance, while the user may wish to adapt the speaker to preferences in a more general sense.

SUMMARY

An object of the present invention may thus be to provide a portable wireless speaker that is flexible in terms of its technical specification.

According to an aspect of the invention, this object, and other objects, may be achieved by a portable wireless speaker arrangement comprising a speaker module for outputting audio. The speaker module comprises a speaker element for generation of the audio, and at least one electric circuit configured for providing a wireless connection between the portable wireless speaker arrangement and a source device and receiving, from the source device, a signal representing the audio and configured for providing an electric output signal to be fed to the speaker element for the generation of the audio.

Moreover, the portable wireless speaker arrangement further comprises a rigid casing arranged to at least partially enclose the speaker module, and a user interaction unit adapted to allow user input, received by the user interaction unit, to control the audio output and/or to the wireless connection with the source device.

Furthermore, the speaker module is adapted to be received by the rigid casing to allow for insertion thereof into the rigid casing and removal thereof from the rigid casing, wherein the rigid casing at least partially encloses the speaker module in that the casing comprises an opening in which the speaker element of the speaker module is arranged when the speaker module is inserted into the rigid casing.

Additionally, the casing comprises a set of battery elements that is integrated with the casing and the speaker module is arranged to receive power from the set of battery elements exclusively.

In view of the above, there is thus provided a portable wireless speaker arrangement comprising an exchangeable speaker module configured to generate audio from a wirelessly received digital audio stream when fed with electrical power, and an exchangeable casing arranged to at least partially enclose the exchangeable speaker module. The casing comprises a set of battery elements and the speaker module is arranged to receive the electrical power from the set of battery elements exclusively. In this context, the term "exchangeable" may refer to that the speaker module may be combined with, e.g. inserted into, a further casing and/or that the casing may be combined with, e.g. hold or partially enclose, a further speaker module.

In this manner, a user may combine a speaker module and a casing to achieve desired technical specifications, e.g. concerning desired battery capacity and/or desired sound properties/power, and desired visual appearance.

Accordingly, the speaker arrangement is adaptable to the user's preference e.g. in terms of perceived audio characteristics and/or desired battery capacity and optionally in terms of visual appearance. As a result, the abovementioned object is achieved.

The user interaction unit may preferably be integrated with the casing or the speaker module. In this manner, the speaker arrangement includes few separate parts. An advantage is hence that the user may not easily lose parts of the speaker arrangement since both the speaker module and the casing, including the set of battery elements, are required in order for the speaker arrangement to be operational, e.g. to play audio, to wirelessly connect to the source device or the like.

Thanks to that the casing comprises the set of battery elements, the visual appearance of the speaker arrangement may be changed while the technical specification in terms of battery capacity may be changed simultaneously. In particular, the exchange of one part, i.e. the casing, the user is able to adapt, i.e. increase or decrease, desired battery capacity according to current needs or desires. Should the casing differ in appearance as well, the appearance may indicate to the user that the casing comes with a "large" or "small" battery capacity, e.g. by means of colour, or different battery symbols where "large" and "small" may preferably be apparent from the symbol.

An advantage of at least some embodiments herein is that the speaker arrangement's cost may be relatively low, and resource efficient, thanks to that the set of battery elements may be reused for different speaker modules. Similarly, reuse of speaker module with different casings, saves cost and resources.

A further advantage may be that the speaker arrangement is compact and space-saving, e.g. thanks to that the user interaction unit may be integrated with the casing or the speaker module.

In some embodiments, the speaker arrangement may be composed of only the speaker module and the casing, i.e. only two parts. An advantage may then be that the speaker arrangement is user-friendly in that there is less risk of losing parts, such as lids for battery compartments or the like.

The casing may be rigid to protect the speaker module, while at the same time the set of battery elements is allowed to be replaced, i.e. by changing the entire casing.

The opening may be adapted to allow the speaker module to be inserted into, and removed from, the casing.

Alternatively, or additionally, in some embodiments, the casing comprises a further opening for allowing the speaker module to be removed from the casing. The further opening may be located oppositely to the opening.

This means that the speaker module may be insertable/removable though the opening or through the further opening.

In some embodiments, the casing comprises four sides, each of the four sides extending from a first face portion to a second face portion at a respective end of the casing, wherein the four sides and the first and second face portions form a space in which the speaker module is insertable into and removable from, wherein at least one side of said at least four sides comprises the set of battery elements.

In some embodiments, the set of battery elements includes at least a first battery sub-element and a second battery sub-element and a pair of opposing sides of the four sides comprises a respective one of the first and second battery sub-element.

In this manner, the portable speaker arrangement may be steadily placed on a surface since weight of the battery element is—at least to some extent—evenly distributed over the casing.

Furthermore, at least one of the other sides, i.e. those one or more sides not forming the pair of opposing sides, may in this manner more easily accommodate the user interaction unit.

In some embodiments, the four sides of the rigid casing are solid and substantially flat. In this manner, prints, markings, logos, different colouring, different textures or the like may easily be applied to the surfaces. As a result, the visual appearance of the speaker arrangement may be easily adapted.

In some embodiments, the casing comprises the user interaction unit. In this manner, sides of the casing may be used to accommodate for the user interaction unit. An advantage is hence that the relatively large areas may be used for receiving user interaction. Thus, reducing requirements on the user to be accurate and precise when controlling the speaker arrangement.

In some embodiments, the speaker module comprises the user interaction unit. In these embodiments, it may be preferred that that user interaction unit is arranged to be accessible from the same face as the speaker module. Since it may be contemplated that the speaker element typically faces the user, when audio is emitted from the speak arrangement, it will then also be simple and convenient to the user to access the user interaction unit.

DETAILED DESCRIPTION

In order to better appreciate the embodiments disclosed herein, a description and analysis of prior art, as realized by the present inventors, is provided in the following.

In view of the foregoing description of background technology, the present inventors have realized that many users are not only interested in changing the visual appearance of their speaker(s), but in addition thereto they may also wish to adapt technical specification of their speaker, such as battery life, characteristics of audio output or the like.

An additional object of the invention may thus be how to provide a speaker that is flexible in terms of its technical specification while at the same time allow the user to change the visual appearance of the speaker.

Figure 1:
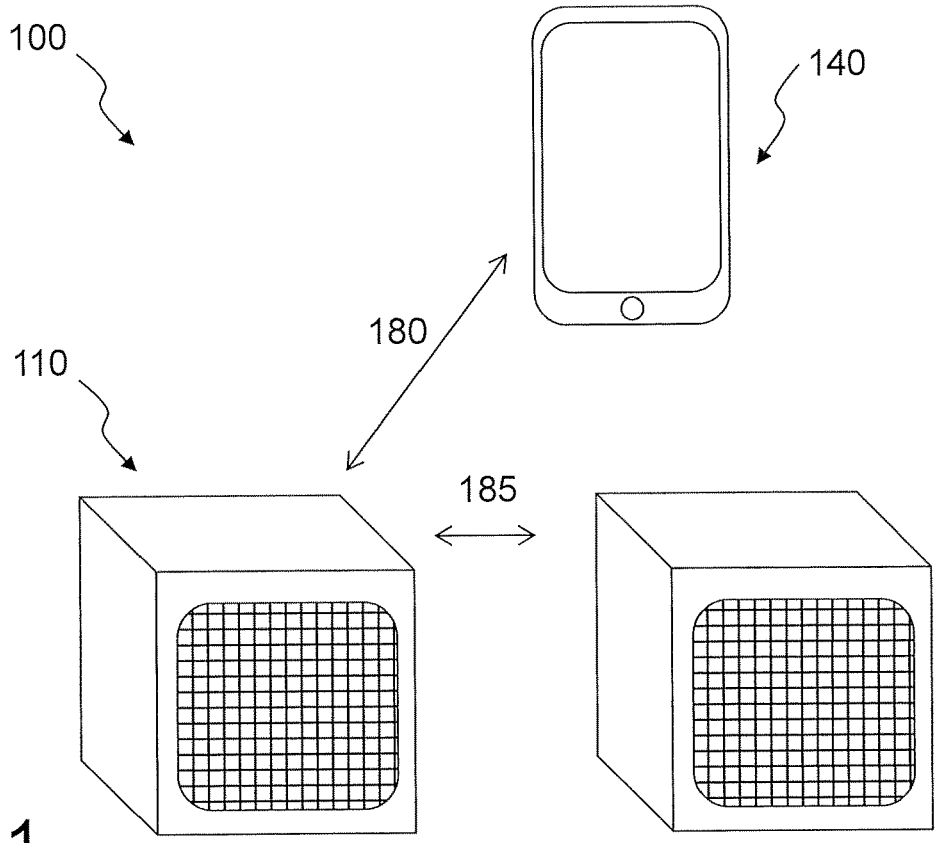
FIG. 1 is an overview illustrating two exemplifying speakers according to the embodiments herein.

FIG. 1 illustrates a system 100 comprising a pair of portable wireless speaker arrangements 110 and a source device 140, such as a smartphone, a tablet, a laptop, a computer, a personal digital assistant or the like.

Typically, the pair of portable wireless speaker arrangements includes two wireless portable speaker arrangements 110 that are compatible, whereby one of the speaker arrangements may provide audio of a first channel and the other speaker arrangement may provide audio of a second channel, e.g. a left and right channel for providing stereo sound.

The source device 140 may be connected to, and transmit, 180 an audio stream, to one of the speaker arrangements 110 of the pair of speaker arrangements. In turn, the speaker arrangement 110 that receives the audio stream may transit 185 the audio stream to the other one of the pair of speaker arrangements. Arrow 180 as well as arrow 185 indicates two-way communication for the purposes of establishing communication, e.g. Bluetooth pairing, and the transmission e.g. digital audio streams.

The portable wireless speaker arrangement 110 comprises a speaker module 120 for outputting audio, such as music, speech, audio tracks to a movie etc.

For ease of description, reference is made to only one portable wireless speaker arrangement 110 in the following with reference to FIG. 2 and subsequent Figures.

The speaker module 120 comprises a speaker element 122, illustrated in FIG. 5 below, for generation of the audio, and at least one electric circuit 124 configured for providing a wireless connection between the portable wireless speaker arrangement 110 and a source device 140 and receiving, from the source device 140, a signal representing the audio and configured for providing an electric output signal to be fed to the speaker element 122 for the generation of the audio.

The portable wireless speaker arrangement 110 further comprises a rigid casing 130 arranged to at least partially enclose the speaker module 120. The casing 130 may have a cuboidal form, such as a rectangular cuboidal form, a rectangular box, an elongated body with a triangular cross-section or the like. Preferably, edges of the casing are rounded.

The speaker module 120 is adapted to be received by the rigid casing 130 to allow for insertion thereof into the rigid casing 130 and removal thereof from the rigid casing 130. See arrow 188. The speaker arrangement 110 is therefore relatively robust and includes few parts. In particular, no lid which typically covers and encloses a battery pack is required. Hooks or the like for such lid can be easily broken.

The rigid casing 130 at least partially encloses the speaker module 120 in that the casing 130 comprises an opening 131 in which the speaker element 122 of the speaker module 120 is arranged when the speaker module 120 is inserted into the rigid casing 130. The opening 131 may have a circular contour, a rectangular contour, a square contour, a triangular contour, an elliptic contour etc. The interior of the casing 130, presenting the opening 131, may have various shapes in order to accommodate any shape that the speaker module 120 may have. Shapes include, but are not limited to, a cuboidal form, a rectangular cuboidal form, a rectangular box, an elongated body with a triangular cross-section or the like. These and other shapes may also be applicable to the casing 130 itself, e.g. presenting these shapes externally, in addition to or alternatively to, that the shapes are presented such as to accommodate various shapes of speaker modules 120. Preferably, the shape of the speaker module 120 matches the shape of the interior of the casing 130, e.g. including the opening 131, but as applicable a different shapes may be used, e.g. a square interior of the casing 130 may enclose a speaker element with a circular cross-section as long as the diameter of the circular cross-section fits within the square interior. Furthermore, the casing 130 may have the same interior and exterior shape, but different shapes also be applicable.

Thanks to the opening 131, an increased freedom of designing the casing may be achieved. A reason for this may be that the material and/or design of the casing may be chosen without affecting audio quality, or at least with only minor impact. For example, choice of material of the casing may not directly affect a sound image, or acoustic image, produced by the speaker element. Therefore, increased flexibility in terms of changing the appearance of the speaker arrangement may be achieved. Further, the casing may be less complex due to that the casing is not required to allow audio to easily pass through it.

The casing 130 comprises a set of battery elements 137 that is integrated with the casing 130 and the speaker module 120 is arranged to receive power from the set of battery elements 137 exclusively. The set of battery elements 137 is adapted to be electrically connected to the speaker module 120 when the speaker module 120 is inserted into the rigid casing 130. Thanks to that the set of battery elements 137 is a sole source of electricity within the speaker arrangement, both an increase and a decrease of battery capacity may be achieved by replacing a first casing with a second casing, which differs from the first casing, e.g. at least, in terms of its battery capacity.

For example, in case a more light-weight speaker arrangement is desired, the casing may typically be replaced with a casing that provides less battery capacity as compared to one currently enclosing the speaker module. That is to say, the embodiments herein do not only enable increase of battery capacity, but rather enable an adjustment of the battery capacity, i.e. an increase or decrease, depending on the user's preference in view of a particular area of use in mind.

Furthermore, the technical specification of the portable wireless speaker arrangement 100 is adaptable e.g. in terms of increase and decrease of quality of sound generating components within the speaker module 120. Those sound generating components may include the speaker element 122, the electric circuit 124, e.g. D/A-converters, electrical conductors, degree of capability to amplify the electric output signal power level etc., robustness of wireless capability, i.e. any portion of the electric circuit 124 that affects perceived audio quality.

Moreover, the portable wireless speaker arrangement 110 comprises a user interaction unit 136 adapted to allow user input, received by the user interaction unit 136, to control the audio output and/or to the wireless connection with the source device 140. The user interaction unit 136 may comprise one or more buttons, touch sensitive panels, light emitting diodes to inform the user of state of the speaker arrangement, push buttons, etc. Control of audio output may be in terms of volume thereof, fast forward/rewind of audio originating from a track of the audio, skip to previous next track of a source of the audio, etc.

The user interaction unit 136 may be integrated with the casing 130 or the speaker module 120. That is to say, in some embodiments, the casing 130 comprises the user interaction unit 136, while in some other embodiments, the speaker module 120 comprises the user interaction unit 136. However, it may also be possible that some parts of the user interaction unit 136 may be integrated with the casing 130 and some other parts of the user interaction unit 136 may be integrated with the speaker module 120.

Hence, in some embodiments, thanks to that the user interaction unit (or control panel) is arranged in the casing, the speaker module may be enclosed within the casing while still allowing the user to easily access the control panel. Should the control panel be arranged at rear of the speaker module (i.e. at an end thereof being opposite to the end where the speaker element is arranged) would not be desired since the rear will, when the speaker arrangement is in use, typically face away from the user, e.g. against a wall, or just simply away from the user and the like. See also FIG. 3*b* below.

In one example, the user interaction unit may be arranged at, or in, the same face as the opening in which the speaker element is arranged when the speaker module is inserted into the casing.

When the user interaction unit 136 is integrated with the speaker module 120 and/or the casing 120 a compact design may be achieved, which includes few parts.

The casing 130 may comprise a further opening for allowing the speaker module 120 to be pushed out of the casing 130, wherein the further opening is opposite to the opening.

Figure 2:
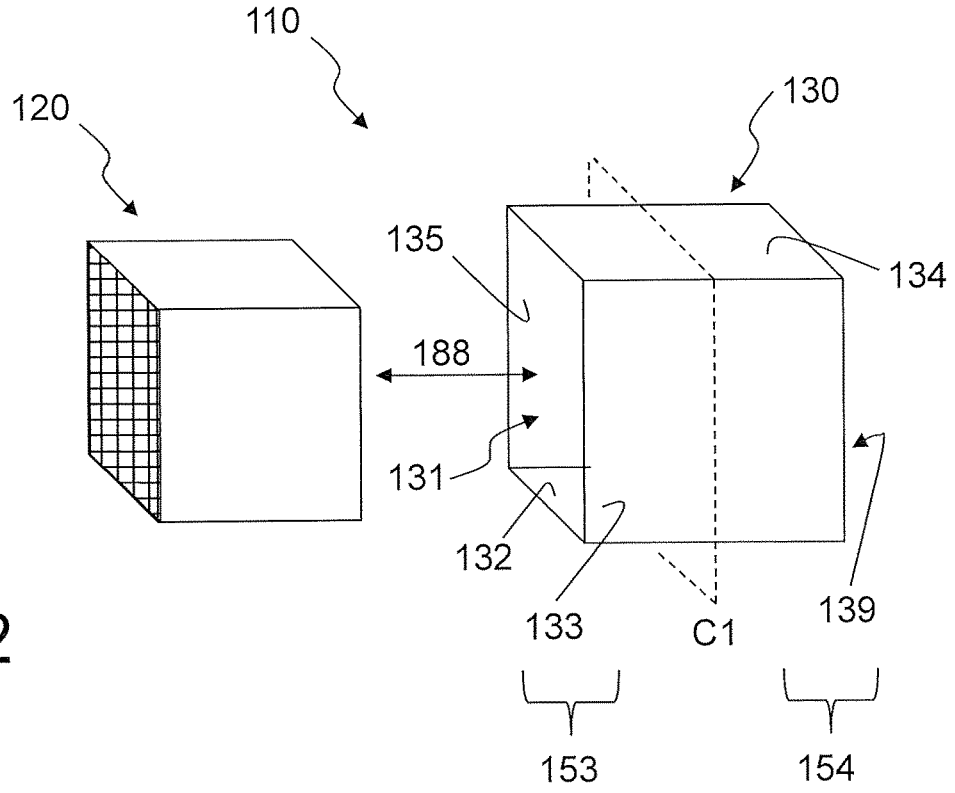
FIG. 2 is a perspective view illustrating the speaker module when extracted from, or to be inserted into, the casing.

As shown in FIG. 2, the casing 130 may comprise four sides 132, 133, 134, 135, each of the four sides extending from a first face portion 153 to a second face portion 154 at a respective end of the casing 130, wherein the four sides and the first and second face portions form a space in which the speaker module 120 is insertable into and removable from, wherein at least one side of said at least four sides comprises the set of battery elements 137.

The four sides of the rigid casing 130 may be solid and substantially flat. In this manner, prints, markings, logos, different colouring, different textures or the like may easily be applied to the surfaces. As a result, the visual appearance of the speaker arrangement may be easily adapted.

Figure 3A:
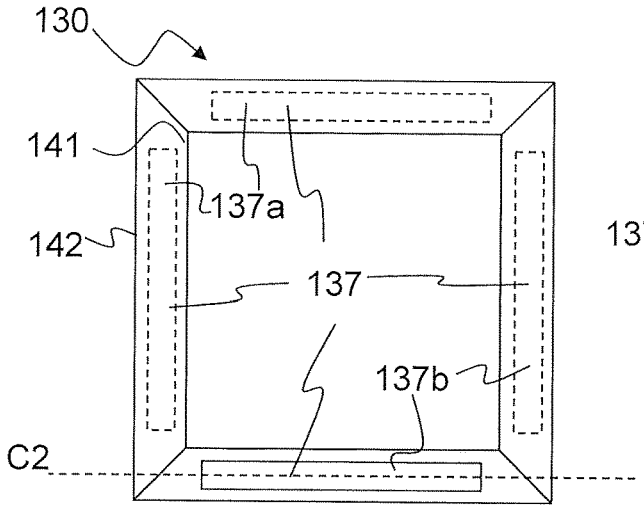
FIG. 3*a* and FIG. 3*b* are cross-sectional views illustrating the casing.

FIG. 3*a* shows a cross-section along the plane C1 in FIG. 2 of the casing 130 of FIG. 2. As shown, the set of battery elements 137 may include at least a first battery sub-element 137*a* and a second battery sub-element 137*b* and a pair of opposing sides of the four sides comprises a respective one of the first and second battery sub-element 137*a*, 137*b*.

In this manner, the portable speaker arrangement 110 may be steadily placed on a surface since weight of the battery element is—at least to some extent—evenly distributed over the casing 130.

Furthermore, at least one of the other sides, i.e. those one or more sides not forming the pair of opposing sides, may in this manner more easily accommodate the user interaction unit 136.

From FIG. 3*a*, it is also clear that the casing 130 may have double walls 141, 142 between which the set of battery elements 137 is arranged. The walls 141, 142 of one side, such as side 132, of the casing may typically form a pair of parallel planes, which are joined with another pair of parallel planes forming another side, such as side 133, of the casing.

Also illustrated in FIG. 3*a*, the casing 130 may have double walls between which the set of battery elements 137 is arranged.

Furthermore, FIG. 2 illustrates, to some extent, that the speaker module 120 is insertable/extractable though the opening 131 or through a further opening 139. In some examples, the further opening 139 may be identical to the opening 131, in which case the opening 131 and the further opening 139 may be adapted to allow the speaker module 120 to be inserted into, and removed from, the casing 130. It is of course enough that only one of the opening 131 and the further opening 139 is adapted to allow insertion and removal of the speaker module 120.

The opening 131 allows for both insertion and/or extraction of the speaker module. In addition, the opening 131 provides for a place/position where a speaker element can be placed to emit audio while being unobstructed by the casing. Thus, the opening 131 enables the audio from the speaker element to be emitted without degradation due to passing through a casing, which would be the case if the opening 131 did not exist. Hence, the opening 131 allows for improved audio quality.

Figure 3B:
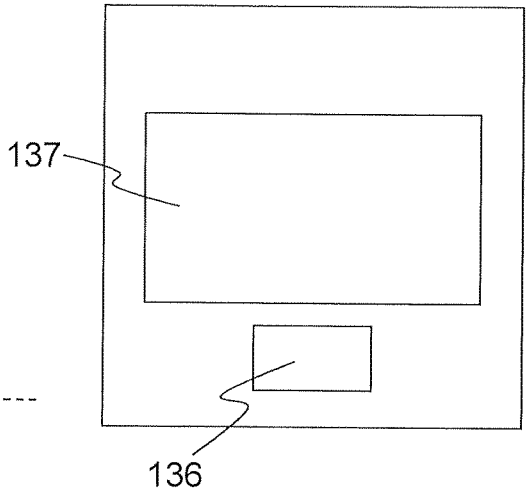

FIG. 3*b* shows an exemplifying side view of the casing 130 of FIG. 2 along a plane C2 of FIG. 3*a*. In this example, a battery element 137 of the set of battery elements is located substantially at the middle of the side in order to set a centre of gravity of the speaker arrangement 110 predictable. In this manner, a user may conveniently predict when the speaker arrangement 110 stands steadily, while at the same time a portion of it has been pushed out over an edge, e.g. an edge of a table or the like.

Figure 4A:
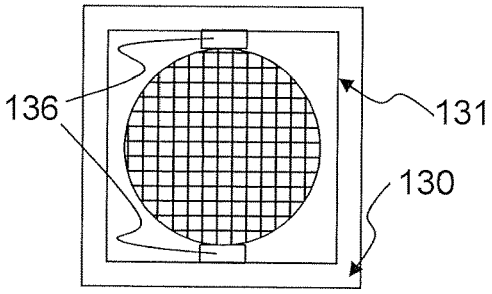
FIG. 4*a* and FIG. 4*b* are views illustrating a face of the speaker arrangement.

FIG. 4*a* shows an exemplifying first face portion 153 in which the opening 131 may be provided. In the illustrated example, the speaker module 120 may comprise the user interaction unit 136. The user interaction unit 136 may comprise a first and a second user input element. The first and second user input elements may be located on a same face of the speaker module 120 as the speaker element 122, but on opposite sides thereof.

In a preferred embodiment, it may be that the first user input element is located further away from a preferred supporting side of the casing 130. The preferred supporting side of the casing 130 is usually supporting the speaker arrangement 110 when it stands on a flat surface, such as a table or the like. The second user input element is arranged closer to the supporting side of the casing than the first user input element. This may be beneficial, e.g. when the first user input element is used for increasing the volume of the audio emitted from the speaker arrangement 110 and when the second user input element is used for decreasing the volume of the audio emitted from the speaker arrangement 110.

It may be particularly beneficial to provide the speaker module 120 with the first and second user input elements when a plurality of speaker arrangements are arranged in an array side by side with each other. The plurality of speaker arrangements may amount to three, four or more units. Sometimes, a first group of speaker arrangements may provide audio of e.g. a left stereo channel and a second group of speaker arrangements may provide audio of e.g. a right stereo channel. Each of the first and second groups may include one or more speaker arrangements. When each group comprises three or more speaker arrangements, it may be—as already mentioned, beneficial to provide each speaker arrangement 110 with said two user input elements as shown in FIG. 4*a*.

Figure 4B:
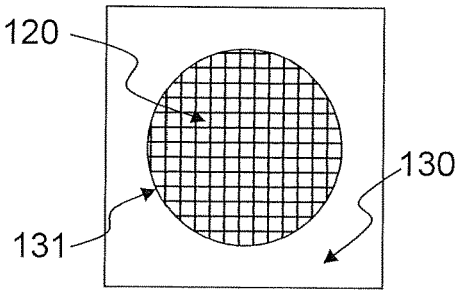

In a further example, as shown in FIG. 4*b*, it may be that the opening 131 is arranged to, e.g. snuggly, receive the speaker element 122. In this example, it may be that the casing 130 comprises the further opening 139 indicated in FIG. 2. In this example, the opening 131 has a shape that is different from the shape of the further opening 139. The further opening 139 (not shown in FIG. 4*b*) is arranged to allow the speaker module 120 to be inserted or extracted into/from the casing 130.

Figure 5:
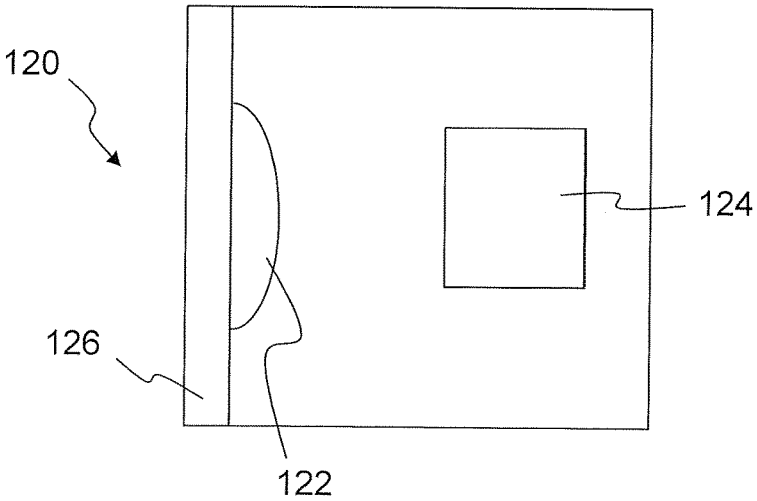
FIG. 5 is a cross-sectional side view of the speaker module.

FIG. 5 illustrates a cross-sectional view of an exemplifying the speaker module 120. As mentioned, the speaker module 120 comprises the speaker element 122, preferably being the sole speaker element 122 of the speaker arrangement 110. With only one speaker element 122, cost of the speaker arrangement 110 may be reduces as compared to known wireless speakers including two or more speaker elements. Traditionally, however, a disadvantage has been that no stereo audio can be provided with only one sole speaker element. Yet, with merging technologies, like aforementioned TWS, two truly separate wireless speakers, such as a pair of the herein disclosed speaker arrangement, may nowadays be capable of providing stereo audio.

Further, by adding one or more further speaker arrangements of the kind disclosed herein, acoustic image may be further adapted to a user's preference.

Moreover, as shown in FIG. 5, the speaker module 120 may include a protective layer 126 to protect the speaker element 122 from e.g. dust, physical damage or the like. Alternatively, or even additionally, the protective layer 126 may be integrated with the casing 130. The protective layer 126 is typically made of a material that easily allows audio or sound waves to pass through it. This kind of protective layer 126 is known in the art.

Figure 6:
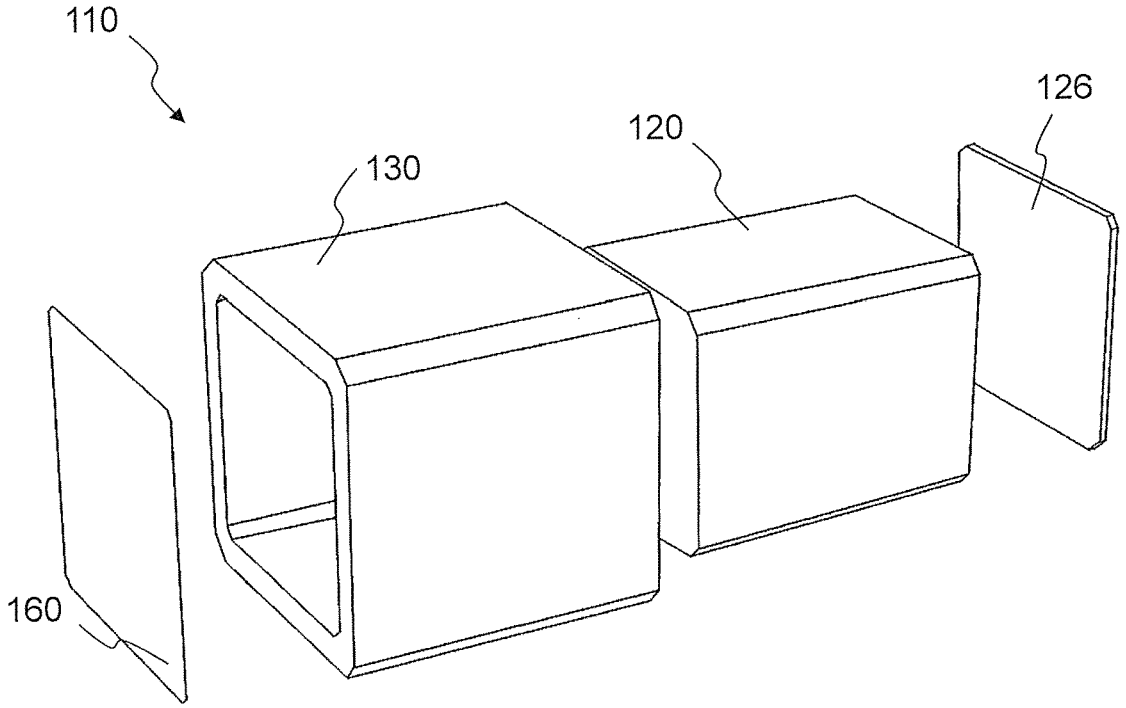
FIG. 6 is an exploded perspective view of an exemplifying speaker arrangement.

FIG. 6 depicts an exemplifying portable wireless speaker arrangement 110 according to some embodiments herein. In this example, the speaker arrangement 110 comprises a casing 130 having two openings, of which only one opening is shown. The two openings may be the opening 131 and the further opening 139 mentioned above.

As in the previous examples, the speaker arrangement 110 further comprises a speaker module 120 having a cuboidal form, or rather a substantially cuboidal form.

Moreover, the speaker arrangement 110 comprises a closure 160, or lid, which is provided to cover one of the two openings, e.g. the further opening 139.

Figure 7:
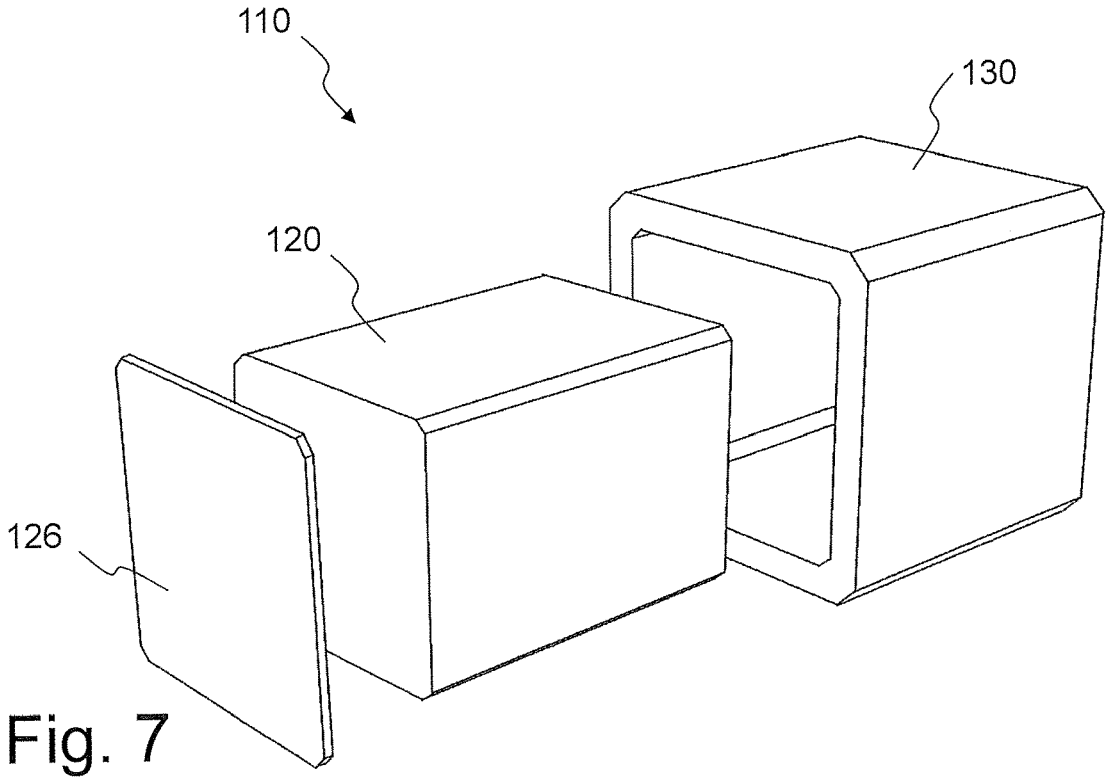
FIG. 7 is another exploded perspective view of another exemplifying speaker arrangement.

FIG. 7 depicts another exemplifying portable wireless speaker arrangement 110 according to some embodiments herein. In this example, the speaker arrangement 110 comprises a casing 130 having only one opening, e.g. the opening 131.

Again, the speaker arrangement 110 comprises a speaker module 120. As in the example of FIG. 6, the speaker module 120 has a substantially cuboidal form.

Figure 8:
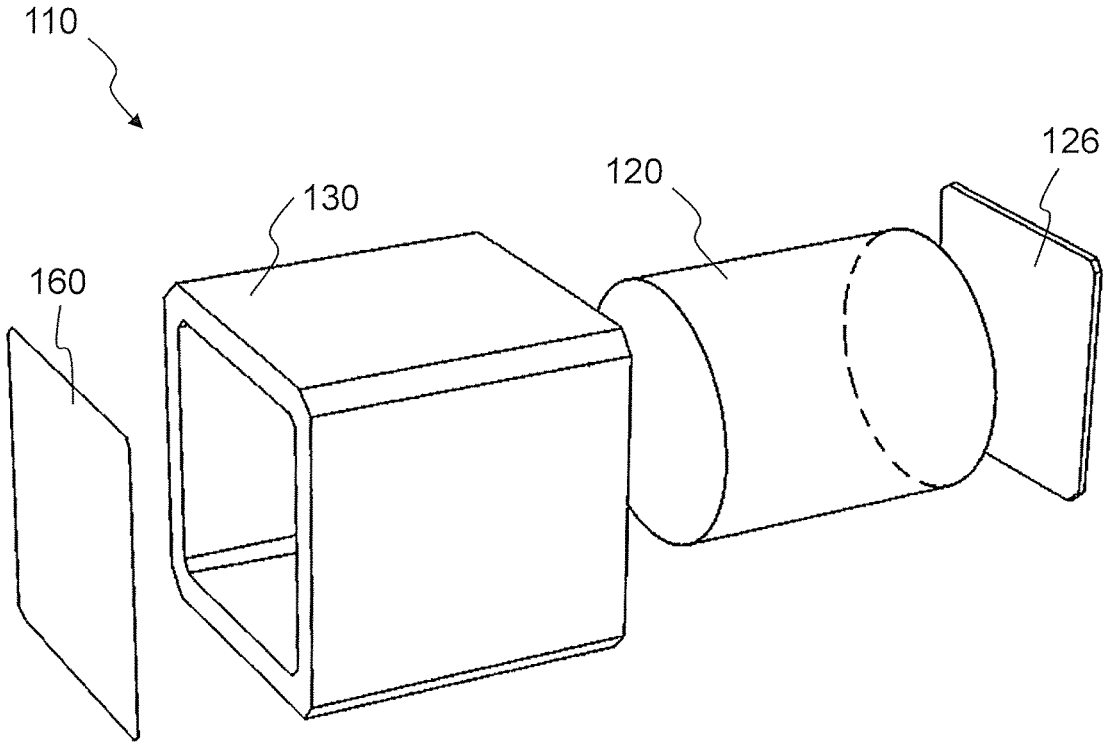
FIG. 8 is a further exploded perspective view of a further exemplifying speaker arrangement.

FIG. 8 depicts a further exemplifying portable wireless speaker arrangement 110 according to some embodiments herein. In this example, the speaker arrangement 110 comprises a casing 130 having two openings, of which only one opening is shown. The two openings may be the opening 131 and the further opening 139 mentioned above.

As in the previous examples, the speaker arrangement 110 further comprises a speaker module 120 having a cylindrical form, or rather a substantially cylindrical form.

Moreover, the speaker arrangement 110 comprises a closure 160, or lid, which is provided to cover one of the two openings, e.g. the further opening 139.

Figure 9:
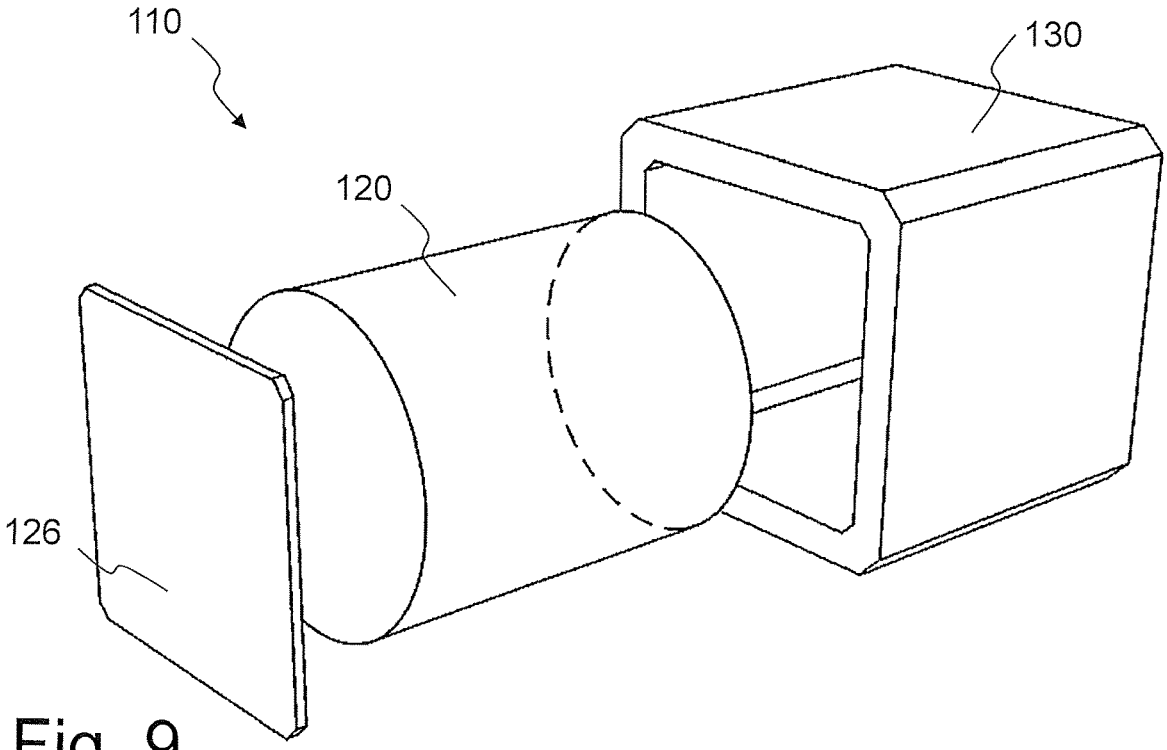
FIG. 9 is a still other exploded perspective view of a still other exemplifying speaker arrangement.

FIG. 9 depicts another exemplifying portable wireless speaker arrangement 110 according to some embodiments herein. In this example, the speaker arrangement 110 comprises a casing 130 having only one opening, e.g. the opening 131.

Again, the speaker arrangement 110 comprises a speaker module 120. As in the example of FIG. 8, the speaker module 120 has a substantially cylindrical form.

Generally, when the speaker module 120 has a substantially cylindrical form, it may be possible to provide the interior of the casing 130 with threads, or thread-like protrusions, and the exterior of the speaker module 120, in particular the cylindrical surface thereof, with threads, or thread-like protrusions. In this manner, it may be possible to allow the speaker module 120 to be screwed into the casing 130. As a result, the speak module 120 is conveniently secured within the casing with risk of sliding out of the casing, e.g. due to gravity.

Each embodiment, example or feature disclosed herein may be combined with one or more other embodiments, examples or features disclosed herein.

Even though embodiments of the various aspects have been described above, many different alterations, modifications and the like thereof will become apparent for those skilled in the art. The described embodiments are therefore not intended to limit the scope of the present disclosure.

The invention claimed is:

1. A portable wireless speaker arrangement comprising:

a speaker module for outputting audio, wherein the speaker module comprises a speaker element for generation of the audio, and at least one electric circuit configured for providing a wireless connection between the portable wireless speaker arrangement and a source device and receiving, from the source device, a signal representing the audio and configured for providing an electric output signal to be fed to the speaker element for the generation of the audio, a rigid casing arranged to at least partially enclose the speaker module, and a user interaction unit adapted to allow user input, received by the user interaction unit, to control the audio output and/or to the wireless connection with the source device, wherein the speaker module is adapted to be received by the rigid casing to allow for insertion thereof into the rigid casing and removal thereof from the rigid casing, wherein the rigid casing at least partially encloses the speaker module in that the casing comprises an opening in which the speaker element of the speaker module is arranged when the speaker module is inserted into the rigid casing, wherein the casing comprises a set of battery elements that is integrated with the casing, wherein the speaker module is arranged to receive power from the set of battery elements exclusively, wherein the speaker module is exchangeable and the rigid casing is exchangeable in that the speaker module is insertable into a further casing and/or that the casing is capable of partially enclose a further speaker module.

2. The portable speaker arrangement according to claim 1, wherein the casing comprises a further opening for allowing the speaker module to be pushed out of the casing, wherein the further opening is opposite to the opening.

3. The portable speaker arrangement according to claim 1, wherein the casing comprises four sides, each of the four sides extending from a first face portion to a second face portion—at a respective end of the casing, wherein the four sides and the first and second face portions form a space in which the speaker module is insertable into and removable from, wherein at least one side of said at least four sides comprises the set of battery elements.

4. He portable speaker arrangement according to claim 3, wherein the set of battery elements includes at least a first battery sub-element and a second battery sub-element and a pair of opposing sides of the four sides comprises a respective one of the first and second battery subelement.

5. The portable speaker arrangement according to claim 3, wherein the four sides of the rigid casing are solid and substantially flat.

6. The portable speaker arrangement according to claim 1, wherein the casing has double walls between which the set of battery elements is arranged.

7. The portable speaker arrangement according to claim 1, wherein the casing comprises the user interaction unit.

8. The portable speaker arrangement according to claim 1, wherein the speaker module comprises the user interaction unit.

* * * * *